US006386382B1

(12) United States Patent
McCausland

(10) Patent No.: US 6,386,382 B1
(45) Date of Patent: May 14, 2002

(54) WATERCRAFT ACCESSORY

(75) Inventor: William Thomas McCausland, Avalon (AU)

(73) Assignee: Sunbum Pty Limited, New South Wales (AU)

( * ) Notice: Subject to any disclaimer, the term of this patent is extended or adjusted under 35 U.S.C. 154(b) by 46 days.

(21) Appl. No.: 09/662,422

(22) Filed: Sep. 15, 2000

Related U.S. Application Data

(63) Continuation-in-part of application No. 09/008,052, filed on Jan. 16, 1998, now abandoned.

(30) Foreign Application Priority Data

Jan. 17, 1997 (AU) ..... P04658

(51) Int. Cl.[7] ..... B65D 43/12

(52) U.S. Cl. ..... 220/4.21; 220/4.22; 220/4.23; 220/349; 220/351; 220/799; 206/811

(58) Field of Search ..... 220/4.21, 4.22, 220/4.23, 349, 351, 799; 206/811

(56) References Cited

U.S. PATENT DOCUMENTS

| | | | |
|---|---|---|---|
| 1,509,137 | A | 9/1924 | Gottlieb |
| 1,599,419 | A | 9/1926 | Klein |
| 1,619,782 | A | 3/1927 | Archila |
| 1,712,680 | A | 5/1929 | Svensson |
| 1,714,877 | A | 5/1929 | Kaufman |
| 1,809,696 | A | 6/1931 | Heilweil |
| 1,851,750 | A | 3/1932 | Cartuschka |
| 1,902,978 | A | 3/1933 | VonFrankenberg |
| 1,989,527 | A | 1/1935 | Powers |
| 2,006,773 | A | 7/1935 | Moore |
| 2,148,169 | A | 2/1939 | Merolle |
| 2,207,543 | A | 7/1940 | Knapp |
| 2,586,740 | A | 2/1952 | Swanson |
| 3,048,301 | A | 8/1962 | Arpin |
| 3,144,167 | A | 8/1964 | Schultz |
| 3,311,248 | A | 3/1967 | Marchant |
| 3,643,831 | A | 2/1972 | Casper |
| 3,791,875 | A | 2/1974 | Koehler |
| 3,962,740 | A | 6/1976 | White |
| 4,108,152 | A | 8/1978 | Kahler |
| 4,285,082 | A | 8/1981 | Cox |
| 4,545,772 | A | 10/1985 | Stockhausen |
| 4,592,734 | A | 6/1986 | Metiver |
| 4,744,461 | A | 5/1988 | Lapham |
| 4,871,079 | A | 10/1989 | Doucette |
| 4,905,857 | A | 3/1990 | Her |
| 4,955,835 | A | 9/1990 | Hollingsworth |
| 5,127,860 | A | 7/1992 | Kraft |
| 5,460,558 | A | 10/1995 | Woodstock |
| 5,484,312 | A | 1/1996 | Zepeda |

FOREIGN PATENT DOCUMENTS

| | | |
|---|---|---|
| AU | B-54940/90 | 5/1990 |
| BE | 526458 | 8/1956 |
| WO | WO 95/16372 | 6/1995 |
| WO | WO 96/35348 | 5/1996 |

*Primary Examiner*—Stephen P. Garbe
*Assistant Examiner*—Joseph C. Merek
(74) *Attorney, Agent, or Firm*—David P. Gordon; David S. Jacobson; Thomas A Gallagher

(57) ABSTRACT

A container for storage of items during watersports is described, having a base (10) affixed to the watersports equipment such as a surfboard or diver's gas tank and a body forming a waterproof enclosure detachably secured to the base. The top cover (14) of the body has tabs (44) which are retained under projections (22) of the base such that the bottom tray (12) and top cover of the body cannot be unsealed without disengaging the body from the base.

The top surface (40) of the cover forms a ramp engageable by the foot of the surf rider and may have grip material attached thereto.

9 Claims, 3 Drawing Sheets

WATERCRAFT ACCESSORY

This application is a continuation-in-part of Ser. No. 09/008,052, filed Jan. 16, 1998 now abandoned.

BACKGROUND OF THE INVENTION

The present invention relates to an accessory for storage of items during watersports such as surfing, boating and diving.

DESCRIPTION OF THE PRIOR ART

During surfing and other watersports, the participant may be a long way from the shore. Car keys, in particular, often now include electronic components and cannot be taken into the water and thus are usually left on the shore where they are vulnerable to theft. Similarly, a person whose work requires them to be 'on call' cannot take a pager into the surf and thus will often abstain from surfing on the chance that he or she will be contacted. Others will rely on a pre-arranged visual signal, such as a two-coloured towel being inverted, to return to shore.

SUMMARY OF THE INVENTION

The present invention aims to provide a means by which persons can combine their passion for watersports with the demands of the electronic age.

The present invention provides a container for storage of items during watersports having a base adapted for attachment to watersports equipment or a watersports participant, and a body detachably secured to the base forming a waterproof enclosure for storage of the items.

Preferably, the device includes a seal which keeps the enclosure waterproof, the arrangement being such that the seal cannot be released without removing the body from the base.

In one preferred form, the base is adapted to be affixed to an exposed surface of watersports equipment, for example to the deck of a surfboard or other watercraft, or to a diver's air tank. The bottom surface of the base may be shaped to suit the intended application—preferably flat or slightly concave to suit the deck of a watercraft, or significantly concave to match the contour of a cylindrical diving tank. Alternatively, the base could include a formation for attachment of a strap for securing the device around the waist of the diver or other watersports participant.

Additionally, if the device is to be fixed to the deck of a surfcraft such as a surfboard, the body may form a ramp or other formation for engagement by the rider's foot.

DETAILED DESCRIPTION OF THE PREFERRED EMBODIMENTS

Figure 1:
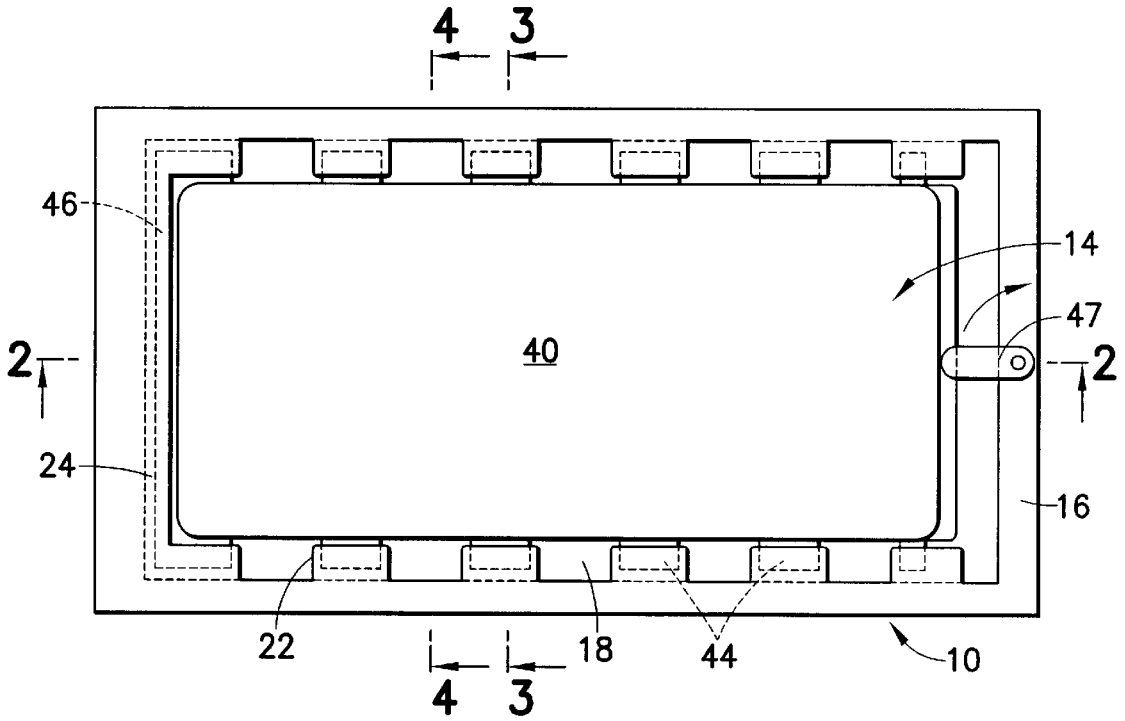
FIG. 1 is a plan view of a device adapted for application to the deck of a surfboard.
Figure 2:
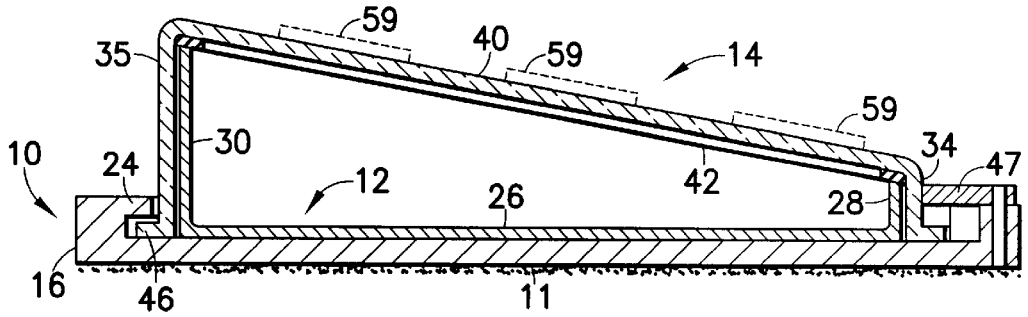
FIG. 2 is a longitudinal cross section along line 2—2.

The device as illustrated consists generally of a base plate 10, a tray 12 and cover 14. The base plate 10 has on its undersurface a preferably waterproof adhesive layer 11 for attachment to a water-exposed surface of the watercraft, such as to the deck of a surfboard or other surfcraft. Other means of attachment, such as screws or straps, may be provided where appropriate to the specific application of the device.

The size and shape of the device, and the contour of the bottom of the base plate, e.g., flat or concave may be varied to suit the type of craft to which the device is to be affixed.

The base plate 10 has a raised peripheral portion 16 with a series of regularly spaced inwardly projecting projections 22 along both sides, and an overhanging flange 24 at the rear end of the base. Both the projections 22 and flange 24 are spaced above the floor 25 of the base plate, thus forming undercut slots for receiving formations on the cover, as will be described below.

The body consists of a bottom part (tray 12) and a top part (cover 14), which fit together before securing to the base, as will be described later with reference to FIG. 5.

Referring to FIGS. 1 to 4, the tray 12 has a floor 26, a short front wall 28, higher rear wall 30 and side walls 32 sloping in height between the two.

The cover has front 34, rear 36 and side 38 walls and a top 40, and is adapted to closely receive the tray so that the floor of the tray is substantially level with the bottom of the cover. Inside the cover, along the edges between the top 40 and the walls 34, 36, 38, is a seal 42 shown in FIGS. 2–4. When the tray is received fully within the cover, the top edges of the tray contact this seal, sealing the cavity between the tray and cover against the ingress of water. The tray and/or cover inner surface may also include a resiliently compressible material to minimise rattling of the items placed in the cavity.

Figure 3:
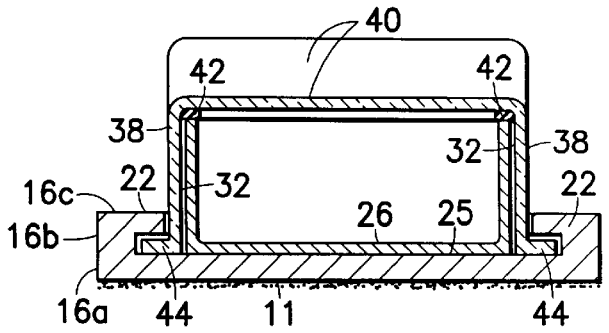
FIGS. 3 and 4 are transverse cross sections along line 3—3 and 4—4 respectively.
Figure 4:
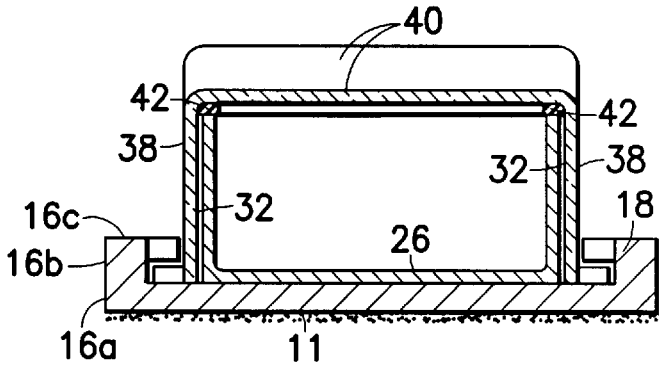

Projecting transversely from the bottom of the cover side walls 38 are a series of horizontal tabs 44 sized and spaced to pass downwards in the spaces 18 between the projections 22 on the base and then be pushed longitudinally (eg. rearwards) so that the tabs 44 are held under the projections 22, as best seen in FIG. 3. A rear flange 46 on the cover is held under the rear overhanging flange 24. A cam 47 on the front of the base may be turned to prevent accidental disengagement.

When the body is thus locked down onto the base, the bottom of the tray is held against the base. The tray cannot move out of engagement with the seal 42 without removal of the body from the base and so the cavity remains waterproof.

Figure 5:
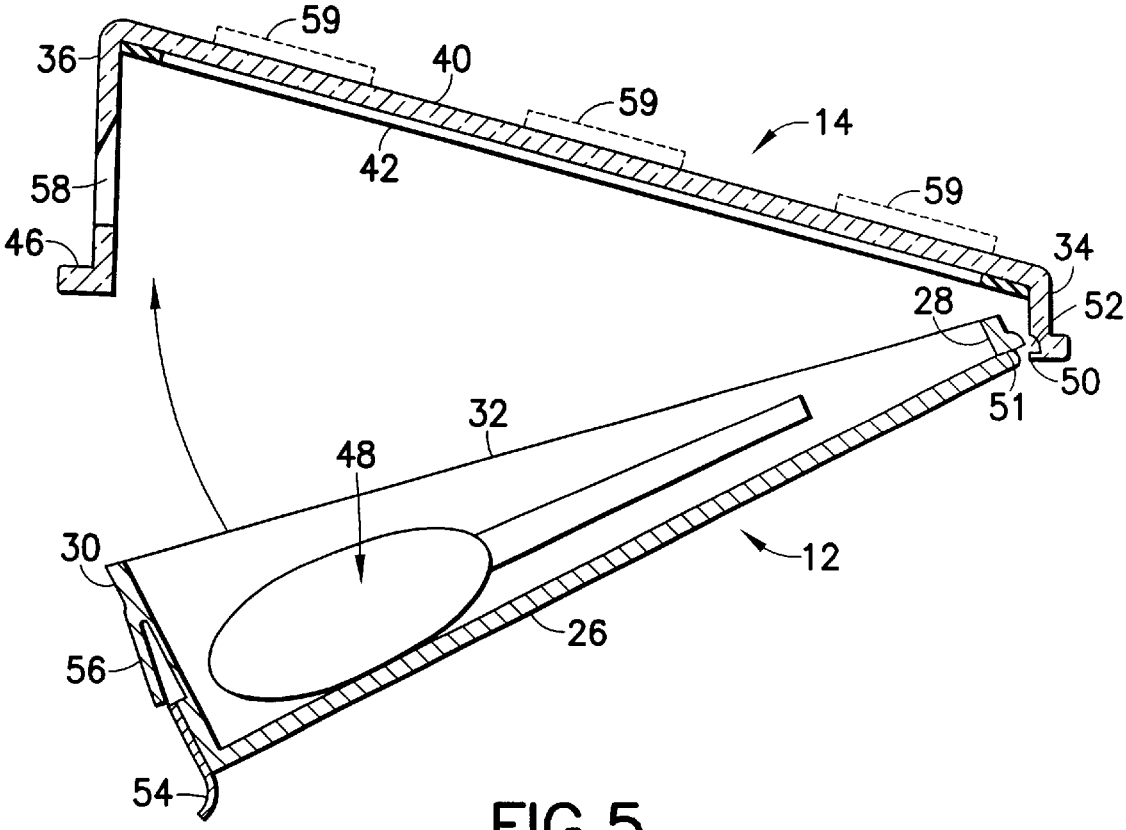
FIG. 5 is a longitudinal cross section of the container being closed.

FIG. 5 is a longitudinal cross-section of the body being closed to contain an article, such as an electronic car key 48. The tray 12 and the cover 14 are hingedly coupled to each other at 50, preferably by a live hinge. The short front wall 28 of the tray 12 has a lug 51 which engages with a recess 52 inside the cover front wall 34. With the key 48 in position in the tray, the tray and cover are then pivoted together so that the tray is received in the cover and engages with seal 42, as described earlier with reference to FIGS. 2 to 4. The rear wall 30 of the tray may have a tang 56 and the cover a corresponding recess 58, to snap fit the cover and tray together.

The rear wall 30 of the tray may have a tag 54 which may be pulled to help release the tray from the cover once the tang 56 has been pushed to release the snap fit. The tag is flexible so that it does not interfere with attachment of the body to the base.

FIGS. 1 to 5 show the device with a sloping top, adapted to be attached to the deck surface of a surfboard at a position corresponding generally to the rear foot position of the rider. The container is adapted to be large enough to hold an electronic car key, for example about 10 cm×5 cm in plan view and 2 cm at its maximum height. The sloping top surface of the cover forms a ramp which is engageable by the rider's rear foot, and especially the arch of the foot, to provide additional grip and support. The ramp may have grip material 59, for example foam rubber of the type often applied to surfboards, applied to its surface.

Figure 6:
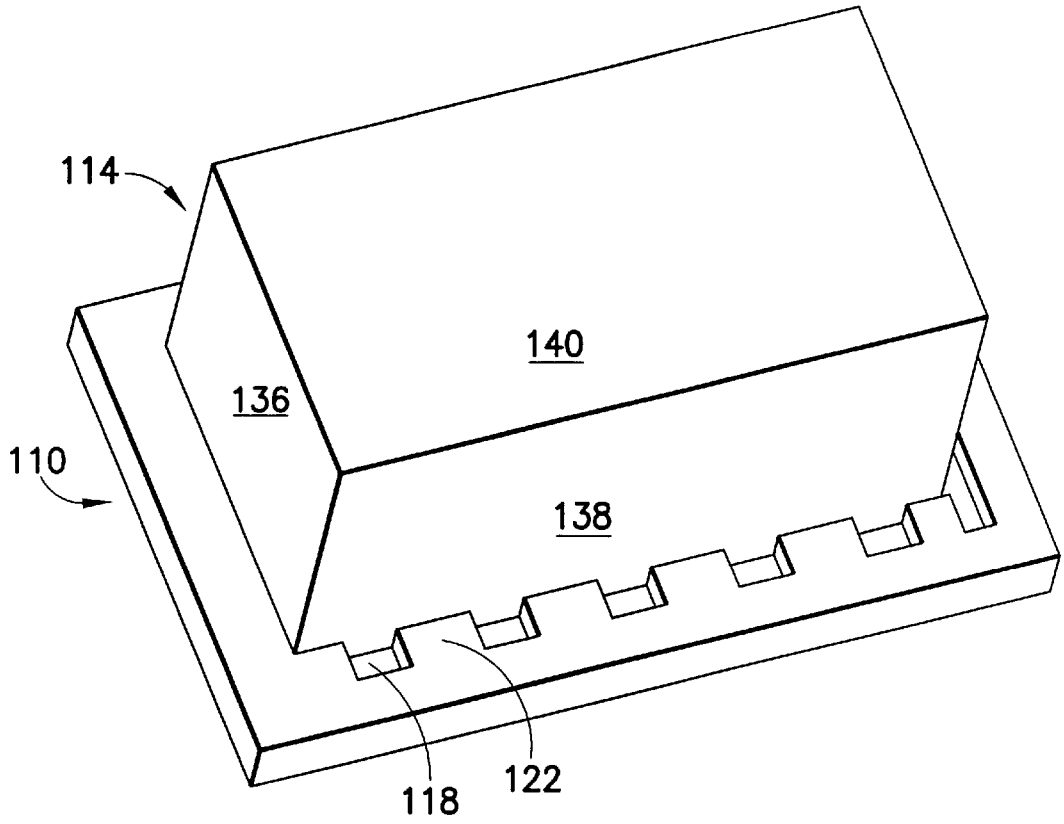
FIG. 6 is a schematic perspective of a larger volume container.

FIG. 6 is a schematic perspective showing an alternative container shape for more general purpose use, attachable to any convenient position on the watercraft or other watersports equipment and generally similar in construction and operation to the device of FIGS. 1 to 5. In FIG. 6, like parts to the embodiments of FIGS. 1–5 are provided with like numbers increased by 100. Thus, the base plate 110 is provided with projections 122, while the cover 114 is shown having a rear 136, side walls 138 and a top 140. In FIG. 6, the cover is shown as being rectangular in three dimensions.

In FIG. 6, at least part of the body may be transparent, preferably at least the top 140 of the cover, so that the item in the container remains visible to the user, for example for pagers or other communications devices which emit a visible signal for incoming messages. The cover construction may have the top 140 formed as a transparent, flexible panel through which the user can operate pressure-sensitive electronic equipment by depressing the surface.

Figure 7:
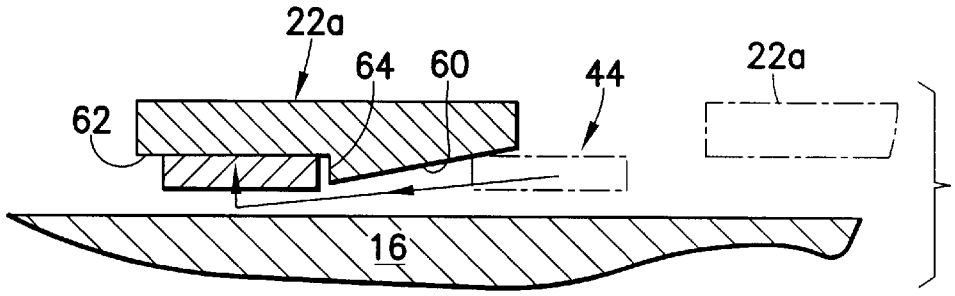
FIG. 7 is a detail longitudinal cross section showing an alternative embodiment.

FIG. 7 is an enlarged detail of a modified undercut slot arrangement for secure engagement between the base 10 and the body. In the embodiment, the underside of overhanging projections 22*a* on the base have a downwards facing ramp 60 and a rebated portion 62 of height intermediate the maximum and minimum ramp height, separated from the lowermost end of the ramp 60 by a short vertical wall 64. The height differences involved need only be small, for example 2 mm height difference along the ramp 60 and a 1 mm jump up to the rebated portion 62.

A first advantage of this arrangement is more secure locking of the body to the base, as the tabs 44 on the cover ride under the ramps, and are trapped in the rebated portion behind the vertical wall 64. Resilient engagement between the cover and tray, including the seal 42, ensures that the tab is held in the rebated portion until the user deliberately disengages the body from the base by pressing down on the cover and sliding it along. A further advantage may be attained by having the tray contact the seal 42 while the bottom of the tray still sits slightly proud, for example 1–2 mm, of the bottom of the cover. Thus, the tray contacts the base first, and when the tabs 44 are forced under the ramp 60 and into rebated portion 62 the seal 42 between the tray and the cover is held in compression.

The body also serves as a convenient container for the items when removed from the base. Electronic keys and other equipment may be safely stored in the detached container while on shore and then the container and contents can simply be clipped onto the base on the water sports equipment while surfing, sailing or diving.

In an unillustrated embodiment, the device shown in FIGS. 1–5 may further be provided with a horizontal plate with tabs similar to those on the body, the plate being inserted in place of the body when it is not desired to carry the container on the surfboard. The plate will minimise discomfort to the rider's foot which might be caused by the projections 22 of the base, and the top of the plate may also carry grip material. Another plate may also be provided, incorporating a hanging strap so that the board may be hung up for storage.

In a further unillustrated embodiment, the engagement between the body and the base can be circular, such as a bayonet or screw engagement.

In all embodiments the base may be provided with straps or other attachment means for attaching to the body of a watersports participant.

While particular embodiments of this invention have been described, it will be evident to those skilled in the art that the present invention may be embodied in other specific forms without departing from the essential characteristics thereof. The present embodiments and examples are therefore to be considered in all respects as illustrative and not restrictive, the scope of the invention being indicated by the appended claims rather than the foregoing description, and all changes which come within the meaning and range of equivalency of the claims are therefore intended to be embraced therein.

What is claimed is:

1. A container for storage of items during watersports, and for attachment to a water-exposed surface of watersports equipment, said container comprising:

a base with means for attachment to the water-exposed surface of the watersports equipment; and a body detachably secured to said base, said body including a top part and a bottom part located between said top part and said base, said top and bottom parts urged together by engagement of said top part with said base and thereby locating said bottom part completely within said top part encasing said bottom part between said top part and said:base so forming a waterproof enclosure for storage of the items above the water-exposed surface, wherein engagement of the body with the base is accomplished by a linear interlocking movement and prevents said top and bottom parts from being separated from sealing engagement with each other, and the top part includes tabs which are retained under corresponding projections on the base when said waterproof enclosure is formed.

2. A container for storage of items during watersports according to claim 1 wherein the body includes means to be engaged by a human foot.

3. A container for storage of items during watersports according to claim 2 wherein the body forms a ramp.

4. A container for storage of items during watersports according to claim 2 wherein the body is provided on an upper surface thereof with a grip material.

5. A container for storage of items during watersports according to claim 1 wherein said means for attachment is a waterproof adhesive.

6. A container for storage of items during watersports according to claim 1 wherein said top part and said bottom part are hingedly coupled to each other.

7. A container for storage of items during watersports according to claim 1 wherein said top part and said bottom part are coupled to each other by a live hinge.

8. A container for storage of items during watersports, comprising:

a base having means for attachment to watersports equipment; and a body detachably secured to said base, said body having a top part and a bottom part which fits within said top part to form a waterproof enclosure, and said top part engaging said base via a linear interlocking movement in a manner which urges said top part into waterproof engagement with said bottom part and prevents said top part and said bottom part from separating from each other.

9. A container for storage of items during watersports, comprising:

a base having means for attachment to watersports equipment; and a body detachably secured to said base, said body having a top part and a bottom part which fits completely within said top part to form a waterproof enclosure, said top part and said bottom part being hingedly coupled to each other, and said top part engaging said base in a manner which urges said top part into waterproof engagement with said bottom part and prevents said top part and said bottom part from separating from each other.

* * * * *